US006107590A

United States Patent [19]

Skindhoj et al.

[11] Patent Number: 6,107,590

[45] Date of Patent: Aug. 22, 2000

[54] CIRCUIT-BREAKER WITH AN EXPLOSIVE CHARGE IGNITED DURING OPENING OPERATION

[75] Inventors: Jorgen Skindhoj, Baden; Bodo Bruhl, Kunten; Kurt Kaltenegger, Lengnau; Lorenz Muller, Gebenstorf; Lutz Niemeyer, Birr; Thomas Schoenemann, Buchs; Lukas Zehnder, Baden, all of Switzerland

[73] Assignee: ABB Research Ltd., Zurich, Switzerland

[21] Appl. No.: 09/290,179

[22] Filed: Apr. 13, 1999

[30] Foreign Application Priority Data

Apr. 14, 1998 [DE] Germany ..... 198 16 506

[51] Int. Cl.[7] ..... H01H 33/04; H01H 9/30; H01H 33/88

[52] U.S. Cl. ..... 218/1; 218/43; 218/57; 218/60; 218/65; 218/85

[58] Field of Search ..... 218/1, 43, 57–67, 218/68–85, 149–151, 90, 95

[56] References Cited

U.S. PATENT DOCUMENTS 3,704,354 11/1972 Lagofun ..... 218/85
4,250,365 2/1981 McConnell ..... 218/95
4,354,072 10/1982 Noeske ..... 218/57
4,563,556 1/1986 Goldstein ..... 218/90
5,359,174 10/1994 Smith et al. ..... 218/150
5,828,026 10/1998 Bruhl et al. ..... 218/150

*Primary Examiner*—J. R. Scott
*Attorney, Agent, or Firm*—Burns, Doane, Swecker & Mathis, L.L.P.

[57] ABSTRACT

Extending between a fixed tulip contact (1) and a slide tulip (4) is an arcing chamber (5) which is occupied in the closed position by a movable contact pin (3) which fills up both an exhaust (9) surrounded by the slide tulip (4) and a blowout opening (7) which is surrounded by the tulip contact (1) and connects the arcing chamber (5) to a pressure chamber (6). The arcing chamber (5) is surrounded by an annular heating volume (13) open toward the same. Arranged in the pressure chamber (6) is a charge (10) of explosive which is for the most part converted within approximately 10–30 ms after ignition to extinguishing gas, preferably predominantly nitrogen, the gas pressure moving the contact pin (3) toward the open position. After clearance of the blowout opening (7) and the exhaust (9), the arc drawn between the contact pin (3) and tulip contact (1) is blown out, something which is supported by the pressure buildup, to which the arc contributes, in the heating volume (13). The pressure chamber with the charge can also surround the arcing chamber in an annular fashion. In this case, it is also possible to support the opening movement by the explosion pressure, for example, via pistons.

14 Claims, 3 Drawing Sheets

CIRCUIT-BREAKER WITH AN EXPLOSIVE CHARGE IGNITED DURING OPENING OPERATION

BACKGROUND OF THE INVENTION

Field of the Invention

The invention relates to a circuit-breaker such as those used in power plants, transformer substations and other installations in the supply of electric energy for connecting and disconnecting operating currents and overcurrents.

Discussion of Background

Circuit-breakers of the generic type have long been known in which the arc struck during an opening operation between the contact members is extinguished by extinguishing gas from a pressure volume. The pressure is produced in this case by a piston which is driven simultaneously with the second contact member by a switching drive, or is even formed by a part of the same, see DE-A-196 13 568, for example. However, as a result the switching drive is exposed to a high load which requires the same to be generously dimensioned. This naturally has an effect on the production costs of the circuit-breaker.

EP-B-0 548 390 and U.S. Pat. No. 4,617,436 have also disclosed switching devices in which use is made in the switching drive of charges of explosive which are ignited in order to trigger an opening operation. The gas produced during the explosion acts on a piston which is operationally connected to a movable contact member and drives the same into the open position under the action of the gas pressure. The gases produced during the explosion are, however, kept away from the contact members and not used for blowing out an arc possibly drawn between the same.

Also known are fuses in which an electric connection is severed by the explosion of an explosive charge. DE-A-35 37 314 describes such a fuse with a tubular bridge conductor which is centrally constricted and surrounded by a pressure chamber and on whose outside an explosive charge is fitted circumferentially in the pressure chamber. The pressure chamber is lined with a material which, after ignition of the explosive charge and blasting of the bridge conductor emits, under the influence of a forming arc, electro-negative gas. The electro-negative gas forms, together with the gases produced by the explosion, a highly pressurized extinguishing gas which flows off into an expansion chamber while blowing out the arc. Use in fuses of powders which form extinguishing gas is also known from EP-A-0 657 910 and EP-A-0 641 005.

However, fuses must be at least partially replaced after a single opening operation. In the case of that described in DE-A-35 37 314, not only is the explosive charge consumed and the bridge conductor destroyed, but the extinguishing gas is additionally essentially produced by the action of the arc on the lining of the pressure chamber, which is likewise used up in this case. Moreover, a time delay which is not conducive to an effective blowout operation may result between the production of the highly pressurized explosion gases and the flow chiefly triggered by them and the emission of electro-negative gas not triggered until the arc occurs.

SUMMARY OF THE INVENTION

Accordingly, one object of the invention is to improve a circuit-breaker of the generic type in such a way that the arc is exposed to a strong extinguishing gas flow without this leading to an additional loading of the switching drive.

This is achieved according to the invention by providing at least one pressure chamber having at least one charge of an explosive which can be ignited during an opening operation and which is converted at least partly into extinguishing gas during the explosion, thereby ensuring that the arc is exposed to a strong extinguishing gas flow even without the use of mechanical means. In suitable developments of the circuit-breaker according to the invention, the switching drive is not only relieved, but also supported, and can be of correspondingly small dimensions, something which substantially reduces the cost of the circuit-breaker. The switching drive can even be omitted entirely in some circumstances.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
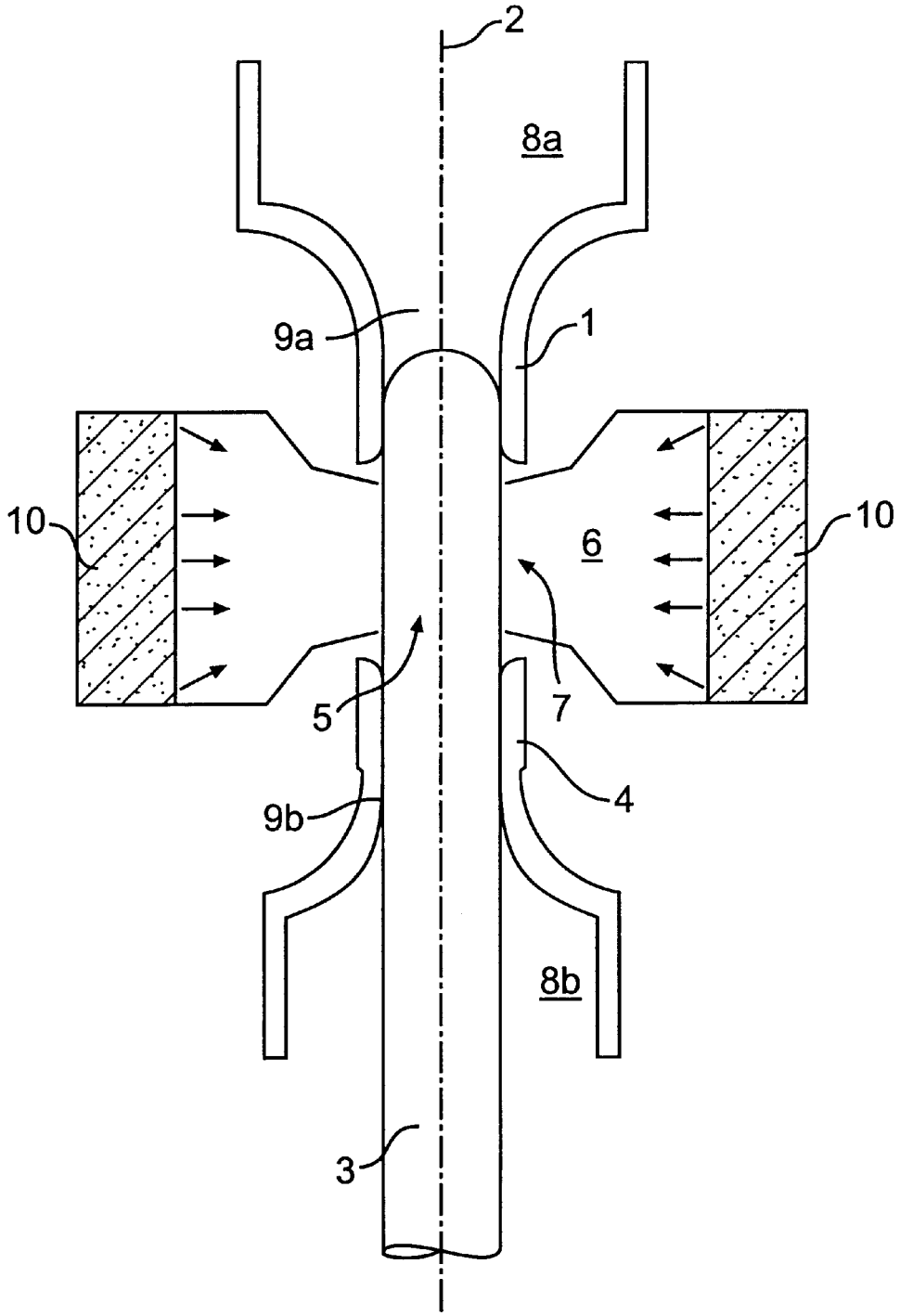
FIG. 1 shows in a schematic fashion a partial axial longitudinal section through the consumable switchgear arrangement of a circuit-breaker in accordance with a first embodiment of the invention.

Referring now to the drawings, wherein like reference numerals designate identical or corresponding parts throughout the several views, the consumable switchgear arrangement, represented in a schematic fashion in FIG. 1 in the closed position, of a circuit-breaker in accordance with a first embodiment of the invention has a fixed first contact member which is constructed as a tulip contact 1 with resilient contact fingers which surrounds a switching axis 2. Provided as movable second contact member is a contact pin 3 which can be shifted along the switching axis 2 between the represented closed position and an open position in which it is withdrawn behind a slide tulip 4 which makes contact with it in the closed position. Situated between the tulip contact 1 and the slide tulip 4 is an arcing chamber 5 which is occupied in the closed position by the contact pin 3 and surrounded on all sides by a pressure chamber 6. The arcing chamber 5 and the pressure chamber 6 are connected via an annular blowout opening 7. Adjoining the arcing chamber 5 on the closing side in the direction of the switching axis 2 is a first exhaust volume 8*a* and, on the opening side, a second exhaust volume 8*b*, which are connected to the arcing chamber 5 the open position by exhausts 9*a*, 9*b* surrounded by the tulip contact 1 and the slide tulip 4, respectively, while they are sealed in the open position by the contact pin 3. The circuit-breaker can also have nominal current contacts (not represented) which are separated in each case in front of the contact members of the consumable contact arrangement in the case of an opening operation.

Arranged on the outer wall of the pressure chamber 6 is an explosive charge 10 which partly fills up the pressure chamber 6 and which is ignited at least under specific conditions in the event of an opening operation. It is also possible to provide a plurality of charges distributed over the circumference of the pressure chamber 6. The charge 10 can in any case be present pressed in tablet form, or as a cartridge with a pulverulent explosive filled in a housing. Said explosive can have the most varied compositions. However, when it explodes it should be converted into reaction products which are suitable at least predominantly for arc extinction. Nitrogen is preferred as the extinguishing gas in this case, in order to avoid environmental stresses.

Environmentally harmless explosives which are suitable for use in circuit-breakers according to the invention and whose reaction products have a high proportion of nitrogen are chiefly known from so-called airbags, which are widely used as safety devices in motor vehicles and are also suitable for use in circuit-breakers according to the invention. An example is $21NaN_3+KNO_3+4Fe_2O_3+2.5SiO_2$, which is converted during the explosion into $10.5Na_2O+0.5K_2O+4Fe+2.5SiO_2+4FeO+32N_2$. This explosive contains no halogens and is also otherwise environmentally friendly, with the result that the exhaust volumes 8*a, b* can also be open. A further example of a suitable explosive is a mixture of 71.6% $SrNiO_3$, 3.77% V6M015060, 3% paraffin, 21.6% guanidine-5,5'-azotetrazolate, which is converted into 8.2% $CO_2$, 31.1% $H_2O$, 43.7% $N_2$ and 15.6% $SrCO_3$.

During an opening operation, the contact pin 3 is moved downward by a switching drive (not represented), in which process it clears the exhaust 9*a* which connects the arcing chamber 5 to the first exhaust volume 8*a*. In this case, there is struck between the contact pin 3 and the tulip contact 1 an arc which, when the tip of the contact pin 3 passes the slide tulip 4, commutates onto the same, with the result that it burns between the tulip contact 1 and the slide tulip 4. The contact pin 3 is moved further downward until it clears the exhaust 9*b* between the arcing chamber 5 and the second exhaust volume 8*b*.

The temperature and pressure of the arc now ignites the charge 10, whereupon the explosive contained in the charge 10 is converted in a very short time approximately 10 to 30 ms, but normally at most 50 ms into gas which contains a high proportion of extinguishing gas—nitrogen, in the example set forth above. The gas yield is usually at least 0.2 l/g, normally 0.5 to 1 l/g, with the result that there is built up very quickly in the pressure chamber 6 a high pressure which is then discharged in a strong gas flow from the pressure chamber 6 via the arcing chamber 5 and the two exhausts 9*a, b* into the two exhaust volumes 8*a, b*. The arc is intensively blown out and extinguished in the process.

Instead of the charge 10 being ignited by the direct action of the arc on it, its ignition can also be triggered by a separate ignition device which responds to suitable criteria. This offers the possibility of triggering an ignition only, for example, if the current strength overshoots a specific threshold, for example which is 10 times the nominal current, if there is no need for blowing out below the threshold, or weak blowing out sufficient for low fault currents is provided by other means. It is thereby possible for ignition of the charge 10, which does after all render recharging necessary, to be limited to those cases in which it is actually necessary.

A further possibility which can be used to avoid a complicated recharging mechanism is to build up the explosive charges in layers 10*a*. Layers of an electrically insulating material of defined thickness are provided between individual layers 10*b* of the explosive for the purpose of spatially separating the same. Under the action of an arc, the uppermost layer of the insulating material vaporizes in each case and, in so doing, clears the next layer of the explosive, which is then ignited and burns up in a fashion forming gas. This ignition is performed as a rule by the arc, although other ignition mechanisms are also conceivable. In the case of an arc which has a particularly strong current and burns for a long time, a plurality of layers can vaporize and burn up one after another. This arrangement of the explosive has the particular advantage that the gas production is distributed over a relatively large time period, with the result that a particularly intensive and long-lasting blowout of the arc is achieved, Additionally, a circuit-breaker according to the invention can also be connected in series with a conventional circuit-breaker, designed for low fault currents, which takes over the interruption of the same up to a specific current strength, while an opening operation of the circuit breaker according to the invention is triggered only if a higher fault current occurs.

Figure 2:
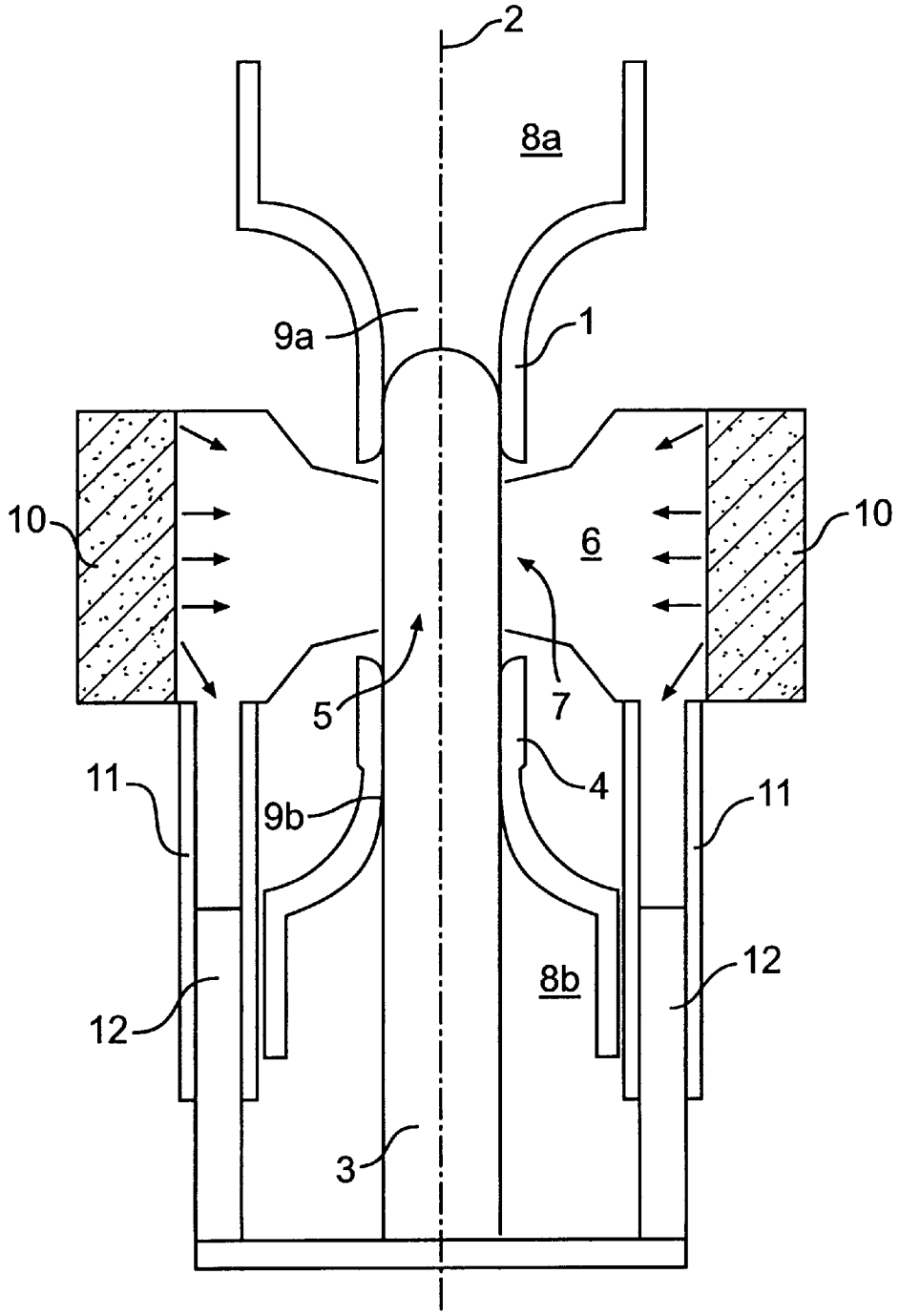
FIG. 2 shows in a schematic fashion a partial axial longitudinal section through the consumable switchgear arrangement of a circuit-breaker in accordance with a second embodiment of the invention.

The consumable switchgear arrangement, represented diagrammatically in FIG. 2, of a circuit-breaker according to the invention in accordance with a second embodiment corresponds in its basic design to that in accordance with the first embodiment. To that extent, reference is made to the description of the latter. However, it additionally has a plurality of cylinders 11 which adjoin the pressure chamber 6 on the opening side, surround the switching axis 2 and are parallel to the same, and in which there are shiftably arranged pistons 12 firmly connected to the contact pin 3.

Upon ignition of the charge 10, the pressure buildup in the pressure chamber 6 acts to the effect that a force acting in the opening direction is applied to the pistons 12 in the cylinders 11. This effects or supports the opening movement of the contact pin 3. The possibilities described above continue to exist in this case with reference to the ignition of the charge 10. Firstly, a mechanical drive can be used to move the contact pin 3 so far toward the open position as to form an arc which suffices to trigger the ignition. The force acting on the pistons 12 then supports only part of the opening movement. In addition, the ignition can also be triggered in another way, for example when the contact pin 3 is still located in the closed position. The incipient pressure buildup then leads from the beginning to a force acting on the pistons 12 which supports the entire opening movement or, given adequate dimensioning of cylinders, pistons and charge, even effects it alone, with the result that it is possible to dispense with a mechanical switching drive entirely.

Figure 3:
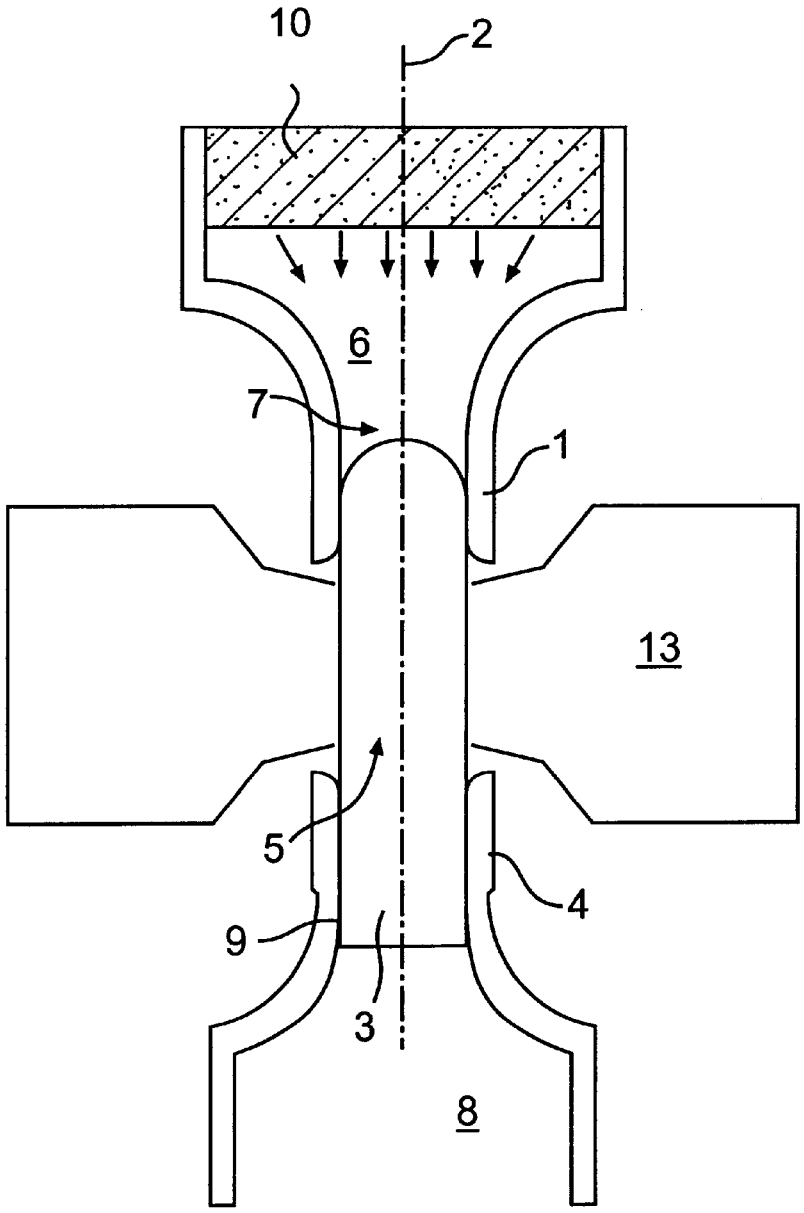
FIG. 3 shows in a schematic fashion a partial axial longitudinal section through the consumable switchgear arrangement of a circuit-breaker in accordance with a third embodiment of the invention.

The consumable switchgear arrangement, represented schematically in FIG. 3, of a circuit-breaker according to the invention in accordance with a third embodiment corresponds essentially, in turn, to that in accordance with the first embodiment. However, only one exhaust volume 8, arranged on the opening side and connected to the arcing chamber via an exhaust 9, is present, while a pressure chamber 6 with a charge 10 is arranged on the opening side of the arcing chamber 5 and in a fashion connected to the same via a round blowout opening 7 surrounded by the tulip contact 1. In the closed position, the contact pin fills up the exhaust 9, and also completely fills up the cross section of the lower part of the blowout opening 7 with its tip. The arcing chamber 5 is surrounded by an annular heating volume 13 which is open toward the heating volume. The charge 10 is ignited in order to trigger an opening operation, for example again when a fault current which overshoots a specific threshold occurs. This leads, in turn, to a rapid pressure buildup in the pressure chamber 6, which applies a force acting in the opening direction to the contact pin 3, which simultaneously acts here as a piston. It is thereby moved in the opening direction and pressed out of the tulip contact 1, striking an arc. This arc is strongly blown out from the start by the extinguishing gas subsequently flowing into the arcing chamber 5, but as a rule this will still not be sufficient for extinction. The extinguishing gas flows into the heating volume 13, where it is strongly heated by the arc, and the pressure rises correspondingly. After the contact pin 3 has also cleared the exhaust 9 to the exhaust volume 8, the pressure prevailing in the heating volume 13 is relieved, particularly during a zero crossing, by a strong gas flow via the arcing chamber 5 and the exhaust 9 into the exhaust volume 8, partly also through the blowout opening 7 into the pressure volume 6. The result is that the arc is strongly blown out and extinguished.

Many modifications of the embodiments described are possible within the scope of the invention. Thus, for example, it is possible to provide a plurality of pressure chambers with charges which are ignited, for example, at set time intervals, or as a function of the position of the contact pin. As already indicated, it is also possible to have a combination with a conventional device for blowing out which, for example, suffices at low current strengths and necessitates ignition of charges only at high fault currents. The pressure chamber can in each case also be relatively small and be filled up completely by the charge. In the case of the consumable switchgear arrangement in accordance with the third embodiment, it is possible to dispense with the heating volume it the charge is dimensioned such that the extinguishing gas flow produced when the same is ignited reliably suffices to extinguish the arc.

It is also possible to provide mechanical devices for automatically replacing used charges by new ones, as is known, for example, from U.S. Pat. No. 4,617,436. It is possible to provide a simple mechanical drive for a closing operation or, if a further circuit-breaker or disconnector is connected in series with the circuit-breaker according to the invention, a resetting spring which restores the contact pin to the closed position immediately after an opening operation.

Obviously, numerous modification and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit-breaker comprising:

at least one consumable switchgear arrangement including:

a first contact member and a second contact member, an arcing chamber situated between said contact members, said second contact member being shiftable relative to the first contact member along a switching axis between a closed position in which the second contact member touches the first contact number and an open position in which the second contact member is separated from the first contact member in the axial direction and clears the arcing chamber, at least one exhaust via which the arcing chamber is connected to at least one exhaust volume, and at least one pressure chamber which is connected to the at least one exhaust via the arcing chamber, wherein the at least one pressure chamber includes at least one charge of an explosive which can be ignited during an opening operation and which is converted at least partly into extinguishing gas during the explosion.

2. The circuit-breaker as claimed in claim 1, wherein the at least one charge burns up within at most 50 ms after the ignition.

3. The circuit-breaker as claimed in claim 1, wherein the explosive is converted to gas at at least 0.2 l/g.

4. The circuit-breaker as claimed in claim 1, wherein the extinguishing gas consists at least predominantly of nitrogen.

5. The circuit-breaker as claimed in claim 1, wherein the at least one pressure chamber is only partially filled by the at least one charge.

6. The circuit-breaker as claimed in claim 1, wherein said switchgear arrangement includes at least one piston which is acted upon during the explosion of the at least one charge in said at least one pressure chamber by gas from the pressure chamber in order to apply a force acting in the opening direction to the second contact member.

7. The circuit-breaker as claimed in claim 6, wherein the at least one piston is arranged shiftably in a cylinder which is connected to the pressure chamber.

8. The circuit-breaker as claimed in claim 7, wherein the at least one cylinder is arranged parallel to the switching axis in a fashion separated from the second contact member.

9. The circuit-breaker as claimed in claim 1, wherein the at least one pressure chamber surrounds the arcing chamber in an annular fashion and has a blowout opening directed toward the arcing chamber.

10. The circuit-breaker as claimed in claim 6, wherein the second contact member is constructed as a contact pin which acts as said piston by virtue of the fact that in the closed state its tip projects into a blowout opening which connects the arcing chamber to the at least one pressure chamber, and at least approximately fills up the cross section thereof.

11. The circuit-breaker as claimed in claim 10, wherein the at least one pressure chamber is arranged adjoining the arcing chamber in the closing direction.

12. The circuit-breaker as claimed in claim 11, wherein at least one heating volume is arranged to the side of the arcing chamber and is open toward the arcing chamber.

13. The circuit-breaker as claimed in claim 12, wherein the heating volume surrounds the arcing chamber in an annular fashion.

14. The circuit-breaker as claimed in claim 1, wherein the at least one charge is constructed in layers, volatile electrically insulating material being provided between the individual layers.

* * * * *